US005555574A

United States Patent [19]

Wason et al.

[11] Patent Number: 5,555,574

[45] Date of Patent: Sep. 17, 1996

[54] SUPPORT FOR END WALL AND SWIMMING POOL COVER

[76] Inventors: Robert P. Wason, 1201 Laurelwood Dr., Crestwood, Ky. 40014; David E. Hall, 1529 46th Ave., Moline, Ill. 61265

[21] Appl. No.: 335,362

[22] Filed: Nov. 3, 1994

Related U.S. Application Data

[63] Continuation-in-part of Ser. No. 137,928, Nov. 15, 1993, abandoned.

[51] Int. Cl.[6] ..... E04H 4/10; E04H 4/00

[52] U.S. Cl. ..... 4/502; 4/506

[58] Field of Search ..... 4/500, 502, 506; 52/169.7, 169.8

[56] References Cited

U.S. PATENT DOCUMENTS

| | | | |
|---|---|---|---|
| 3,019,450 | 2/1962 | Karasiewicz | 4/502 |
| 3,477,185 | 11/1969 | Linton | 52/169.8 |
| 3,654,639 | 4/1972 | Lankheet | 52/169.8 X |
| 4,077,173 | 3/1978 | Rozanski | 4/506 X |
| 4,124,907 | 11/1978 | Laven | 4/506 X |
| 4,203,174 | 5/1980 | Shults | 4/502 |
| 4,232,491 | 11/1980 | Bumgarner, Sr. | 4/506 X |

*Primary Examiner*—Robert M. Fetsuga
*Attorney, Agent, or Firm*—Glenn H. Antrim

[57] ABSTRACT

A reinforcing fixture that is to be connected in multiple to an end wall also has a U-shaped section in and upper horizontal member for supporting a receptacle for a swimming-pool cover and rolling mechanism. Each of the fixture is readily and accurately positioned on the end wall for positioning the receptacle mechanism accurately at the required height relative to the upper edge of adjacent side walls.

2 Claims, 1 Drawing Sheet

SUPPORT FOR END WALL AND SWIMMING POOL COVER

This is a continuation in part of application Ser. No. 08/137,928 filed Nov. 15, 1993, now abandoned.

BACKGROUND OF THE INVENTION

Former swimming pools have included a row of spaced braces fastened to the outer side of each of the walls as shown in U.S. Pat. No. 3,511,002 issued to G. C. Fox on May 12, 1970. For a swimming-pool having a cover, the cover and a wind-up drum are housed in a receptacle that is installed on a support or foundation that is independent of that for an adjacent end wall. Since the cover must be extended at a particular level with respect to the heights of the walls of the pool, tedious effort is required for installation of a support for positioning the receptacle or housing level precisely at the required height.

SUMMARY OF THE INVENTION

According to the present invention, a row of fixtures fastened to an end wall not only reinforce or brace the end wall but also support a receptacle for a cover and rolling mechanism. The fastening of the end wall at the correct height with respect to the adjacent side walls positions the rolling mechanism at the desired height.

A preferred assembly includes an end wall constructed of panels of galvanized steel. The panels have peripheral flanges with mounting holes to facilitate assembly. The fixtures for bracing have upper and lower horizontal members with holes in the appropriate ends so that the fixtures can be readily attached uniformly in particular mounting holes of the panels as the panels are assembled together. The upper member of each of the fixtures has a U-shaped section for fitting transversely about a receptacle containing a cover and rolling mechanism. The uniformity of the panels and the fixtures ensures that a row of fixtures attached to the outer side of the end wall position the U-shaped sections in alignment for supporting a receptacle and that the receptacle will be at the required height relative to the end wall and the adjacent side walls.

A pool using the preferred embodiment of the end-wall assembly must have square corners. Typically, tracks will be provided near the upper edge of side walls for supporting a cover, and therefore the upper surface of the end wall is 1½ inches (1.3 cm) lower than that of the side walls. The upper surface of the end wall may be a 1-foot (30.5-cm) horizontal surface formed by an outward square bend in the upper portion of the end wall.

A rectangular filler and a relatively narrow square filler are fastened between flanges at the respective ends of the end wall and the adjacent flanges of the side walls. The rectangular fillers extend upward from the upper surface of the end wall to the same height as the side walls, and the square fillers are connected between adjacent flanges that extend from the bottom edge of the respective rectangular filler to the lower edges of the adjacent wall panels. Obviously, the rectangular fillers prevent splashing over the ends of the upper surface of the end wall.

DESCRIPTION OF THE PREFERRED EMBODIMENT

Figure 1:
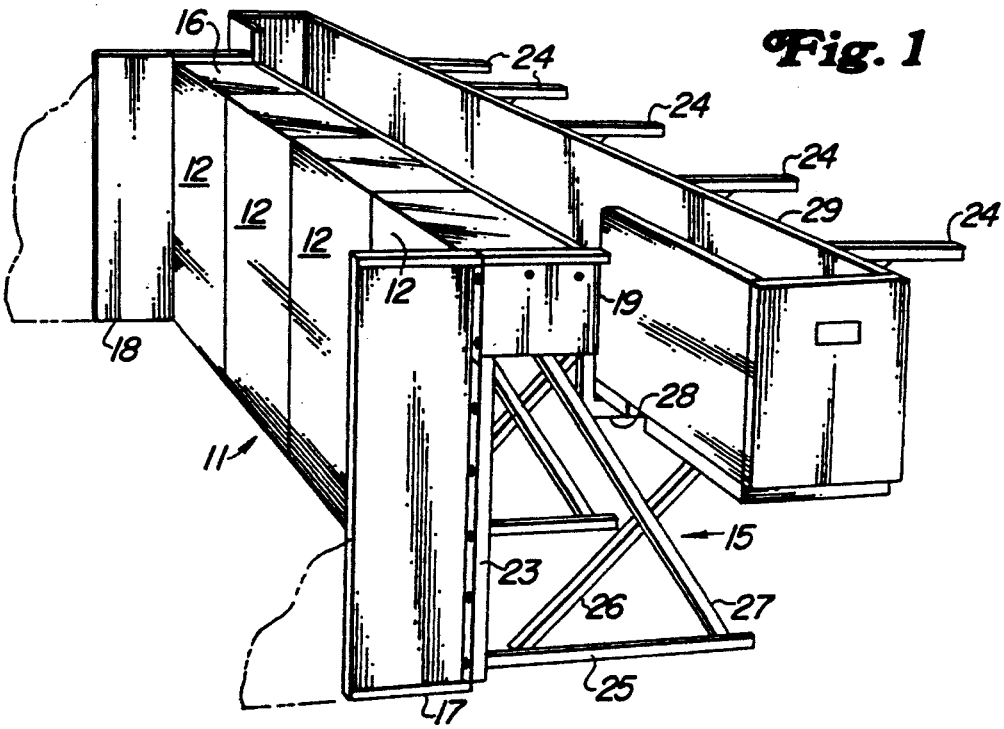
FIG. 1 is a perspective view of the end wall and fixture of this invention and also fragmentary panels of a pool and a supported receptacle for a cover.
Figure 3:
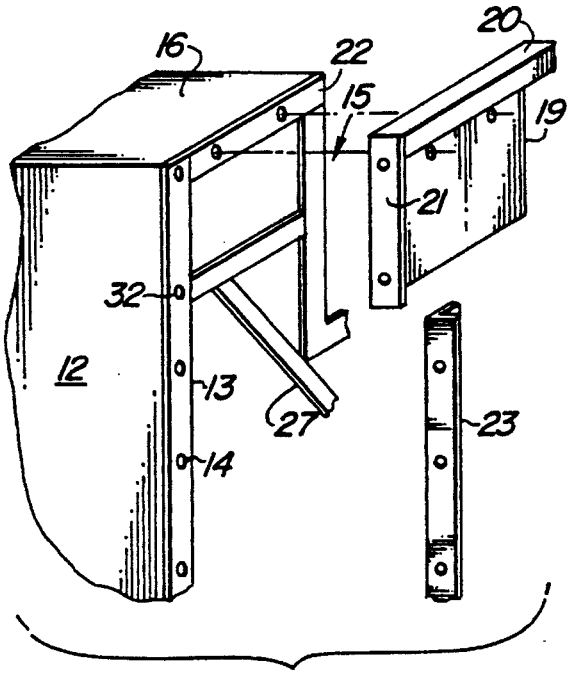
FIG. 3 is a perspective view of a fragmentary portion of the upper end of the end wall and of the fillers for fastening the end wall to an adjacent side wall.

In FIG. 1, a typical rectangular end wall 11 comprises four panels 12 constructed of 14 gage galvanized steel with a 5 mm coating that is insensitive to light. Alternately, the panels may be molded structural foam. With reference to FIG. 3, each panel 12 has a square outward flange 13 along each side thereof and also preferably along the bottom. Evenly space mounting holes 14 through the side flanges 13 are suitably positioned for bolting together adjacent flanges of the panels and at certain upper and lower positions attaching reinforcing and supporting fixtures 15. A square bend at the top of each of the panels 12 provides a horizontal smooth upper surface 16 that is about 1 foot (30.5 cm) across.

Since the rectangular side walls 17 and 18 of a pool to which the end wall 11 is attached, has an upper edge or surface that is about 1.3 cm higher than the upper surface 16 of the end wall 11, a rectangular filler 19 (Figs. 1 & 3) is provided at each end of the end wall 11 to continue across the respective end of the upper surface 16 to enclose the pool at the same height as the adjacent side wall. Each of the rectangular fillers 19 extend downward over an upper portion of an adjacent fixture 15 and has an outwardly, squarely turned flange 20 along the top edge and a similar flange 21 along the inner edge. Mounting holes are provided through the rectangular filler 19 for bolting it to the upper flange 22 of the adjacent panel 12 of the end wall 11, and holes are provided in the side flange 21 for bolting it to the flange of an adjacent side wall. A square filler 23, having flanges of the required width to overlay the flanges of the panels 12, is connected between each end of the end wall 11 and the adjacent side wall 17 or 18 to extend between the lower edge of the respective rectangular filler 19 and the lower edges of the adjacent panels 12 that are being interconnected.

Figure 2:
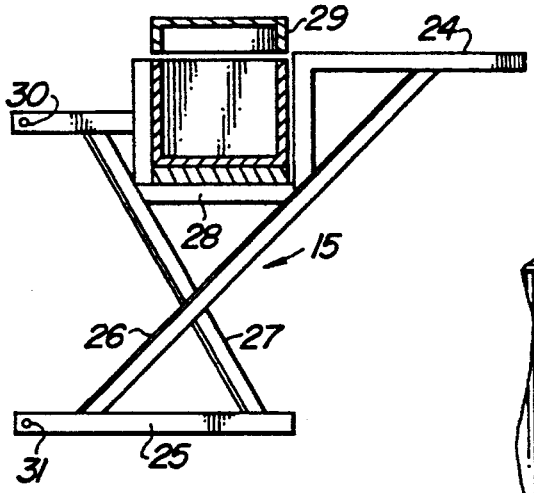
FIG. 2. is a plan view of a side of a supporting and reinforcing fixure shown applied in multiple in FIG. 1.

A fixture 15 like the five similar fixtures in the end wall assembly of FIG. 1 has a side view as shown in FIG. 2. All the members are fabricated from steel having a square angle for rigidity, and the intersections of the members are welded. An upper horizontal supporting member 24 and a lower horizontal member 25 are rigidly interconnected by crossed slanting, reinforcing members 26 and 27. The lower member 25 is used as a base, and the upper member 24 has an intermediate U-shaped section or configuration 28 of the required dimensions to fit about the lower portion of a receptacle 29. Each of the opposite lower corners of the U-shaped section is welded to a respective one of said reinforcing members 26 and 27 above the position where the members cross. For fastening the fixture 15 to a end wall 11, a mounting hole 30 through an end of the upper member may be aligned with a hole 32 (FIG. 3) that is spaced from the upper end of a flange corresponding to the flange 13 of a panel 12, and the mounting hole 31 of the lower member 25 may be aligned with the lower hole in the same flange. In a usual arrangement, a plurality of fastened, spaced fixtures 15 are parallel and each extend perpendicularly outwardly from the side of the end wall.

The depth and width of the U-shaped section 28 and the exact positioning of the reinforcing members 26 and 27 are dependent on the dimensions of the container for the rolling mechanism selected by the prospective user. The bottom of the configuration 28 is usually horizontal to conform to the bottom of the rectangular receptacle 29 that is a staple article of commerce. Since the fixtures 15 are identical and uniformly attached to the wall 11, a fixture that has been made for a particular available receptacle 29 supports the receptacle at the desired height by being installed in a usual manner to function as a brace. Obviously, the vertical sides of the configuration 28 are spaced slightly farther apart than the width of the selected receptacle 29. The fillers 19 and 23 shoe in FIG. 3 are readily applicable for attaching the end-wall assembly 11 to a steel vinyl-lined swimming pool, but by using fillers with usual required fastening means, the assembly 11 may be attached to pools fabricated from other materials such as aluminum, concrete, and molded foam whether installed in the ground or above the ground.

We claim:

1. In a end-wall assembly of a swimming pool having a rectangular end wall between adjacent ends of rectangular side walls, the end wall having a smooth horizontal upper surface at a somewhat lower level than the upper surface of each of said adjacent side walls of said walls of said swimming pool, a plurality of spaced reinforcing identical fixture rigidly secured to side end wall, said fixture being parallel and in respective vertical planes extending perpendicularly outwardly from said end wall in a direction mechanism and pool cover, said receptacle having a horizontal bottom and two vertical opposite sides, wherein the improvement comprises, each of said identical fixtures having a rigid upper supporting member extending generally horizontally outwardly from said end wall, each of said supporting members having an intermediate U-shaped configuration forming a supporting horizontal bottom and two opposite vertical sides, said fixtures being secured precisely at the same level on said end wall such that the bottom of each of U-shaped configurations is on a horizontal plane that is a predetermined distance below said upper surface of said end wall, and said elongated receptacle positioned upright on said supporting horizontal bottoms of a plurality of successive ones of said U-shaped configurations, the respective ones of said vertical sides of said successive configurations being spaced slightly farther apart than the width of said elongated receptacle.

2. An end-wall assembly as claimed in claim 1, having a rectangular filler and a relatively narrow square filler attached to each end of said end wall, said fillers for each of said ends of said end wall connected tightly between said respective end of said end wall and an adjacent one of said side walls, each of said rectangular fillers extending vertically to the height of said upper surface of a respective one of said side walls and outwardly along the adjacent edge of said edge of said upper surface of said end wall, and each of said square fillers extending from the inner portion of the lower edge of said respective rectangular filler to the lower edge of said end wall.

* * * * *

UNITED STATES PATENT AND TRADEMARK OFFICE

CERTIFICATE OF CORRECTION

PATENT NO. : 5,555,574
DATED : September 17, 1996
INVENTOR(S) : Wason et al.

It is certified that error appears in the above-identified patent and that said Letters Patent is hereby corrected as shown below:

Title page,
Item [57], ABSTRACT,
Line 4, insert an -- s --, after "fixture".

Column 2,
Line 56, after "fixture 15 to" delete "a" and insert -- an --.

Column 3,
Line 11, delete "shoe" and insert -- shown --.
Line 22, after "said adjacent side walls" delete "of said walls";
Line 24, insert an -- s -- at the end of "fixture";
Line 24, after "rigidly secured to" delete "said" and insert -- side --.
Line 26, after "said end wall in a direction" insert -- away from said swimming pool, an elongated receptacle of a rolling --.

Column 4,
Line 8, after "the bottom of each of" insert -- said --.

Signed and Sealed this

Thirtieth Day of September, 2003

JAMES E. ROGAN
*Director of the United States Patent and Trademark Office*